US007760091B2

(12) United States Patent
Comerford

(10) Patent No.: US 7,760,091 B2
(45) Date of Patent: Jul. 20, 2010

(54) SECURITY SYSTEM

(76) Inventor: Declan Comerford, 39 Loreto Crescent, Rathfarnham, Dublin, 14 (IE)

( * ) Notice: Subject to any disclaimer, the term of this patent is extended or adjusted under 35 U.S.C. 154(b) by 280 days.

(21) Appl. No.: 11/762,805

(22) Filed: Jun. 14, 2007

(65) Prior Publication Data

US 2007/0241898 A1 Oct. 18, 2007

Related U.S. Application Data

(63) Continuation-in-part of application No. PCT/IB2005/054213, filed on Dec. 13, 2005.

(30) Foreign Application Priority Data

Dec. 14, 2004 (GB) ..... 0427325.6

(51) Int. Cl.
*G08B 13/14* (2006.01)

(52) U.S. Cl. ..... 340/568.1; 340/572.1

(58) Field of Classification Search ..... 340/568.1
See application file for complete search history.

(56) References Cited

U.S. PATENT DOCUMENTS

| | | | | |
|---|---|---|---|---|
| 2,554,223 | A * | 5/1951 | Szabo | 200/52 R |
| 3,314,548 | A * | 4/1967 | Stewart | 211/85.9 |
| 4,205,328 | A * | 5/1980 | Gotanda | 340/521 |
| 4,595,922 | A * | 6/1986 | Cobb et al. | 340/825.49 |
| 4,635,053 | A * | 1/1987 | Banks et al. | 340/5.32 |
| 4,661,806 | A * | 4/1987 | Peters et al. | 340/568.1 |
| 4,673,915 | A * | 6/1987 | Cobb | 340/330 |
| 4,736,193 | A * | 4/1988 | Slocum et al. | 340/522 |
| 5,051,724 | A | 9/1991 | Morrow et al. | |
| 5,521,585 | A | 5/1996 | Hamilton et al. | |
| 6,131,808 | A | 10/2000 | Pires et al. | |
| 6,592,028 | B2 * | 7/2003 | Pires et al. | 235/375 |
| 6,731,211 | B1 * | 5/2004 | King | 340/568.1 |
| 6,867,695 | B2 * | 3/2005 | Prado et al. | 340/568.1 |
| 6,900,741 | B1 * | 5/2005 | Warnelov | 340/933 |
| 7,116,228 | B1 * | 10/2006 | Singleton | 340/572.1 |
| 7,336,174 | B1 * | 2/2008 | Maloney | 340/572.1 |
| 2003/0184437 | A1 | 10/2003 | Maloney | |
| 2003/0234725 | A1 | 12/2003 | Lemelson | |
| 2004/0021570 | A1 | 2/2004 | Maloney | |
| 2004/0032327 | A1 | 2/2004 | Flick | |
| 2008/0258869 | A1 * | 10/2008 | Ognjenovic | 340/5.73 |

FOREIGN PATENT DOCUMENTS

| | | | |
|---|---|---|---|
| EP | 0104072 | | 3/1984 |
| EP | 0149102 | A2 * | 7/1985 |
| WO | WO 03/063517 | | 7/2003 |

* cited by examiner

*Primary Examiner*—Daniel Wu
*Assistant Examiner*—Brian Wilson
(74) *Attorney, Agent, or Firm*—Gordon & Jacobson, PC

(57) ABSTRACT

A security system for securing a set of keys comprises a housing having an external aperture for receiving a security tag which is attached to the keys, the aperture being associated with a locking mechanism which is operable by a keypad to secure the security tag in or release the tag from the aperture. A sensor monitors the presence of the security tag in the aperture, and an alarm is activated if the security tag is removed from the housing without releasing the locking mechanism. The security system eases the location of the keys in an emergency and also provides a straightforward security system for preventing the theft of house or vehicle keys or the like.

11 Claims, 2 Drawing Sheets

SECURITY SYSTEM

This application is a CIP of PCT/IB2005/054213 filed on Dec. 13, 2005.

BACKGROUND OF THE INVENTION

1. Field of the Invention

The present invention concerns a security system, and in particular a security system for securing a set of keys to, in order to enable the ease of location thereof in the case of an emergency, such as a house fire or the like, in addition to providing a straightforward security system for preventing the theft of house or vehicle keys or the like.

2. Related Background Art

With the introduction of more anti-theft devices in vehicles, it is becoming more common for burglaries to be committed simply to obtain a set of keys such as vehicle keys. In many cases the owner of the vehicle is unaware that the keys have been taken until they see that the car is no longer parked outside the premises. It is therefore becoming more and more common, particularly at night when occupants are asleep, not to leave keys within easy reach of possible burglars.

However, placing keys out of reach can often have fatal consequences. Many house fires lead to injury or death when the occupants cannot exit the house because the doors thereto are locked. In the panic that ensues during a fire, the people affected may not be able to locate the keys because of the shock experienced, or due to heavy smoke which leads to additional confusion, especially when the keys are not immediately to hand. House fires normally incapacitate some but not all people within the household. Children often lose their lives or are seriously injured in searching for parents to unlock doors and offer assistance in exiting the premises, while the parents themselves are often unaware as to the exact location of the keys, and thus valuable time is wasted.

It is therefore an aim of the present invention to provide a security system adapted to secure a set of keys thereto, in order to prevent the unauthorised removal thereof. In addition the invention seeks to provide a fixed location at which the keys may be found and also a warning system if for example a fire breaks out in a home.

SUMMARY OF THE INVENTION

According to the present invention, as seen from a first aspect, there is provided a security system comprising a housing having an aperture for receiving a security tag which is to be attached to one or more keys, the aperture being associated with a locking mechanism operable to secure the security tag in or release the tag from the aperture, a sensor to monitor the presence of the security tag in the aperture, and alarm means for generating a warning signal if the security tag is removed from the housing without operation of the locking means.

In use, a security tag can be fitted to a bunch of keys and the keys can be securely stored by inserting the tag into the aperture of the system.

The system will not release the tag until the locking mechanism has been de-activated, thereby preventing the theft of the keys. A warning signal will be generated if the keys are removed without de-activating the system.

The locking mechanism may be arranged to releasably engage the tag, so that the keys can be removed from the system in an emergency, thereby triggering the alarm to alert other persons of the emergency. It is envisaged that the system may be able to optionally releasably engage the tag, so that the removal of car keys can be prevented, whilst the removal of house keys is permitted.

Preferably, means are provided for monitoring one or more environmental conditions in proximity to the housing and for actuating the alarm means if predetermined parameters for the monitored environmental conditions are not met.

In a preferred arrangement, said monitoring means is arranged to monitor for one or more environmental conditions selected from one or more of noise, smoke, heat or carbon-dioxide levels.

It is preferred that the locking mechanism is operated by a keypad which receives an input to lock or disengage the security tag in or from the aperture.

In a preferred arrangement, the security tag includes a microchip that can be read by a detector in the housing in order to verify the authenticity of the tag.

It is envisaged that the housing includes a memory, whereby different inputs can be allocated to different key holders.

It is further envisaged that the memory can be programmed to store varying data relating to the security level required for each key associated with a security tag. For example, if a security tag is attached to keys such as a front door key or a car key where only certain persons are meant to use the key, a memory for the security system can be programmed so that a more complicated or different code input would have to be input via the keypad to release the key from the housing than for say an internal door.

It is envisaged that the alarm means can generate an audible warning signal.

Further, the alarm means is operable to generate a visible warning signal. However, it is envisaged that if required, both and audible and a visible warning signal can be generated.

In a preferred arrangement, the housing also includes one or more lights which are operable to illuminate the security device when the warning signal is generated. This inclusion of lights has the benefit that the housing and keys can be more easily found in a smoke filled environment which improves the chances of householders being able to escape in an emergency situation. The lights can also be used to illuminate an exit for people to escape from a smoke filled room.

Preferably the lights are arranged to illuminate a keypad of the system.

Preferably, the housing also includes an override that is operable to turn off the alarm means. The override is in the form of an on/off switch for a power supply to the security device. This feature is useful in case there is inadvertent operation of the device, for example if a child rather than an intruder tries to remove the key without permission.

In a preferred arrangement, the security system includes switch means so that the system can be switched between sensing the presence of a security tag and environmental conditions or only monitoring the presence of a security tag or environmental conditions. By having the facility to switch between different levels of functions, this provides for maximum adaptability of the device. It may be that at certain times, for example during the day, the only need is to monitor for unauthorised removal of a key, while at night there is also the need to detect whether a fire has started so that house occupants can be alerted to escape as quickly as possible.

It is envisaged that the invention is also directed to a kit of parts comprising a housing as previously described, together with one or more security tags as herein mentioned.

In a preferred arrangement, the security tag is arranged for attachment to the key by a wire cable, preferably a twisted wire cable passing through an aperture in the key.

Preferably, the wire cable is secured to the fob by lockable securing members, such as nuts, which can be released to change keys for the tag or put more keys on the wire cable for a security tag.

Preferably, the securing means is in proximity to the security tag such that when the tag is placed in the aperture of the housing, the securing means are not accessible so that the securing means cannot be released to release the key from the security tag.

In an alternative arrangement, the security tag is secured to the body of the key, with the key being inserted in the aperture in the housing and locked in position.

It is envisaged that the security tag is provided as a plastic key which is attachable by a cable to a domestic key. However, the security tag can be a device which is clipped to the key itself.

Further, the invention is also directed to security tags as mentioned, which can be supplied separately for householders to attach to existing keys so that these existing keys can be secured by the security system.

Also, according to the present invention, as seen from a second aspect, there is provided a security system comprising a housing having an aperture for receiving a key, the aperture being associated with a locking mechanism operable to secure the key in or release the key from the aperture, a sensor to monitor the presence of the key in the aperture, and a signal generator that is operable to actuate a warning signal if the security key is removed from the housing without operation of the locking means.

BRIEF DESCRIPTION OF THE DRAWINGS

The present invention will now be described by way of examples only with reference to the accompanying drawings, in which.

DETAILED DESCRIPTION OF THE PREFERRED EMBODIMENTS

Figure 1:
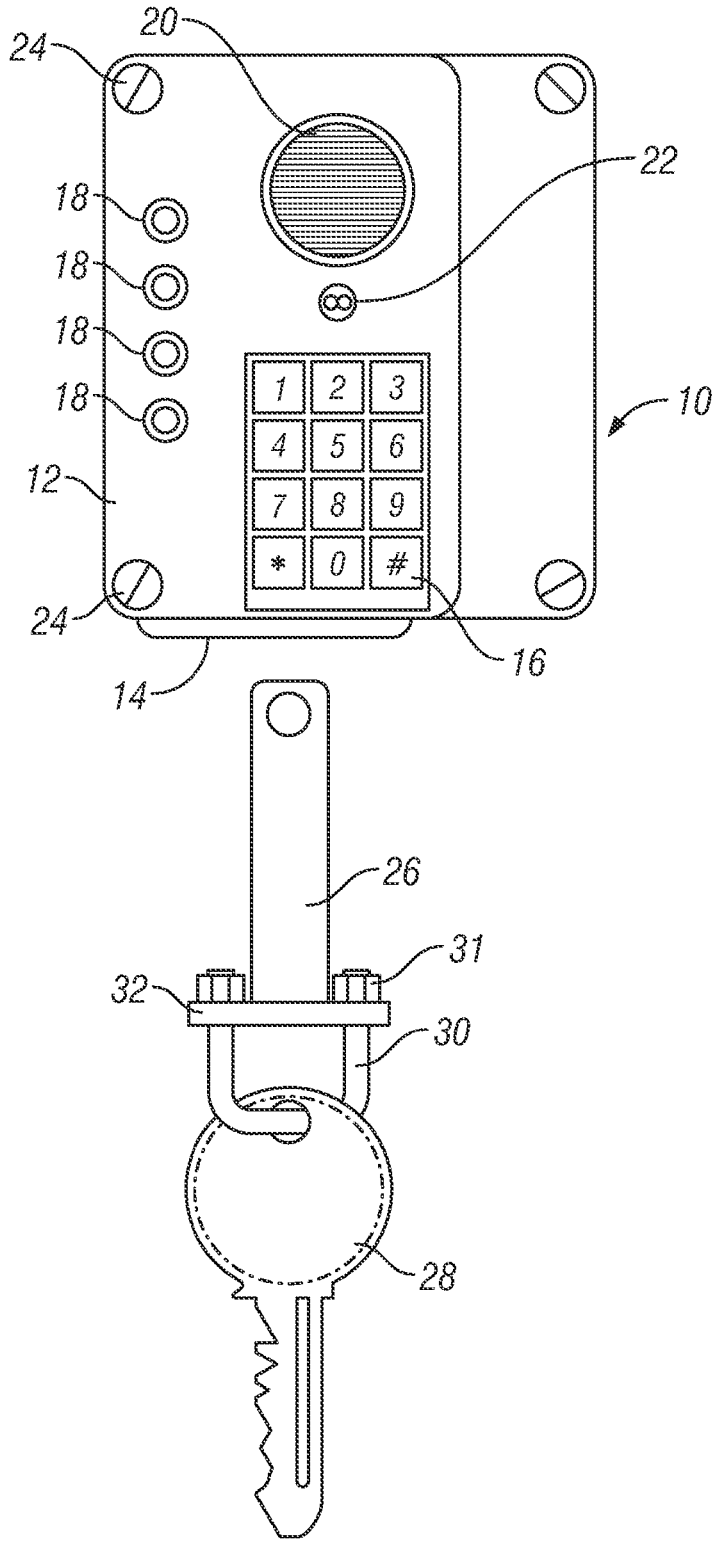
FIG. 1 illustrates a front elevation of an embodiment of security system according to the present invention and a key and fob for releasable engagement with a housing of the system.

Referring now to FIG. 1 of the accompanying drawings, there is illustrated an embodiment of security system, generally indicated as 10, which serves to both locate and secure a key 28 or set of keys such as house or car keys, at a given location, for both safety and security reasons.

The security system 10 consists of a housing 12 which may be formed from any suitable material, for example plastic, preferably a thermosetting plastic or other heat resistant material. The choice of a heat resistant material for the housing 12 is important as the security system 10, as will be described hereinafter, is intended to serve as a beacon or guide during emergencies such as house fires, where significant heat may be experienced, under which conditions the security system 10 must continue to operate. The housing 12 defines a chamber in the form of a slot 14 on the underside of the housing, which is shaped and dimensioned to receive a security tag 26 which may be in the form of a fob or a key.

In use, security tag 26 is securely connected to the key 28 or set of keys (not shown), by way of a shackle which is secured by nut 31 on either side of a mounting plate 32 which is attached to an end of the security tag 26 closest to the key. The key 28 may then be secured to the security system 10 via the security tag 26. It should however be appreciated that the slot 14 could be adapted to directly receive the key 28, although the use of the security tag 26 lends greater versatility to the security system 10, allowing same to be used with keys (not shown) of varying shape and size.

The security system 10 is provided with a keypad 16 which, once the security tag 26 has been inserted into the slot 14, may be used to lock the security tag 26 within the slot 14. The keypad 16 may be configured to accept a single or multi-digit code which, when entered, locks the security tag within the slot 14, by any conventional means. The slot 14 is configured to position the tag 26 in such a position that the nuts 31 securing the shackle 30 are inaccessible, such that when the tag 26 is locked in-situ, it is impossible to undo the nuts 31 to release the key 28. The keypad 16 is preferably backlit, or otherwise rendered highly visible in darkness or low visibility (for example in the presence of smoke), in order to ensure that the keypad 16 may be actuated, without delay, during an emergency. The security system is also configured to effect release of the security tag 26, and thus the key 28, from the slot 14 upon a code being entered on the keypad 16. Different lock and release codes may be utilised, however it will be appreciated that using the same code for both operations simplifies the use of the security device 10, which is an important consideration given the intended function thereof.

Once the security tag 26 has been inserted into the slot 14, and the keypad 16 utilised to lock same, the security system 10 is armed, and will emit an alarm signal if any attempt is made to remove the security tag 26 without first entering the correct release code. In order to generate an alarm signal, the security system 10 is provided with a plurality of lights 18 disposed about the housing 12 to provide a visible warning. In addition a speaker 20 can provide an audible alarm and the speaker is actuated by internal control circuitry (not shown) preferably of conventional electronic form. The control circuitry may be configured and adapted to trigger either a visual or audible alarm signal, or both, in response to a large number of external events.

One such way in which the alarm may be triggered is when an incorrect code is entered on the keypad 16, although the device 10 may be configured to permit one incorrect entry of the release code, before triggering the alarm.

The security system 10 is also preferably provided with a sound detector 22 of any suitable form, which is operable to trigger the alarm in response to smoke or a certain frequency/pitch/volume, in particular to the audio alarm emitted by household smoke alarms (not shown). Thus, in the event of a fire, in addition to the sound of a smoke alarm, the security system 10 itself will issue a further audible/visual alarm. The visual alarm effected by the plurality of lights 18 is of particular benefit, in the event of a fire, as the lights 18 will serve to guide a person directly to the system 10, and so the key 26 located and secured therein, even in the presence of smoke.

As an alternative, the security system 10 could be provided with an on board smoke/heat/carbon monoxide detector (not shown), which would be configured to trigger the alarm of the security system 10 directly. In addition, the security system 10 is preferably provided with internal vibration detectors (not shown), for example a conventional piezo-electric accelerometer based detector or the like. These detectors (not shown) are operable to detect any tampering with the security system 10, and trigger the alarm in response thereto.

Thus, in use, the security system 10 is secured at a desired location, via a pair of fixing screws 24, or indeed any other suitable means. The security system 10 is preferably secured close to an exit, such as a front door (not shown), in order to act as a guide to direct any occupants to both the exit and the keys necessary to unlock same. Once the security system 10 is fixed in position, and an occupant is present on the premises, the key 28 to the premises, or indeed the occupants vehicle, is secured to the security system 10 as hereinbefore described. The security system 10 will then serve two purposes. If as detailed above, the premises are broken into to obtain the keys to the occupant's vehicle, the keys cannot be removed from the security system 10 without triggering the alarm, thereby alerting the occupant to the attempted robbery. In addition the security system 10 serves as a fixed location at which the occupant's keys are located, avoiding the possibility of misplacing the keys.

The second function of the security system 10 is to serve as an emergency indicator, preferably pinpointing the location of an exit (not shown), in addition to the keys for same. Thus, in the event of a fire, the lights 18 will be activated as hereinbefore described, guiding the occupants to the security system 10, and therefore the key 28. The occupant then disarms the security system 10 by keying in the release code on the keypad 16, and removes the key 28 to unlock the door. Any further occupants will then be guided to the opened door by the lights 18, guiding the further occupants to safety.

The security system 10 may be configured to automatically disarm in the event of a fire, preventing the need to key in the release code, thereby reducing the time taken for the occupant to open a given door to exit the premises.

Alternatively, the keypad 16 may be entirely omitted, and possibly replaced with a simple on/off switch (not shown), such that the security system 10 still serves to guide an occupant to the key 28, which can then be quickly and easily removed to enable the door to the premises to be unlocked.

Figure 2:
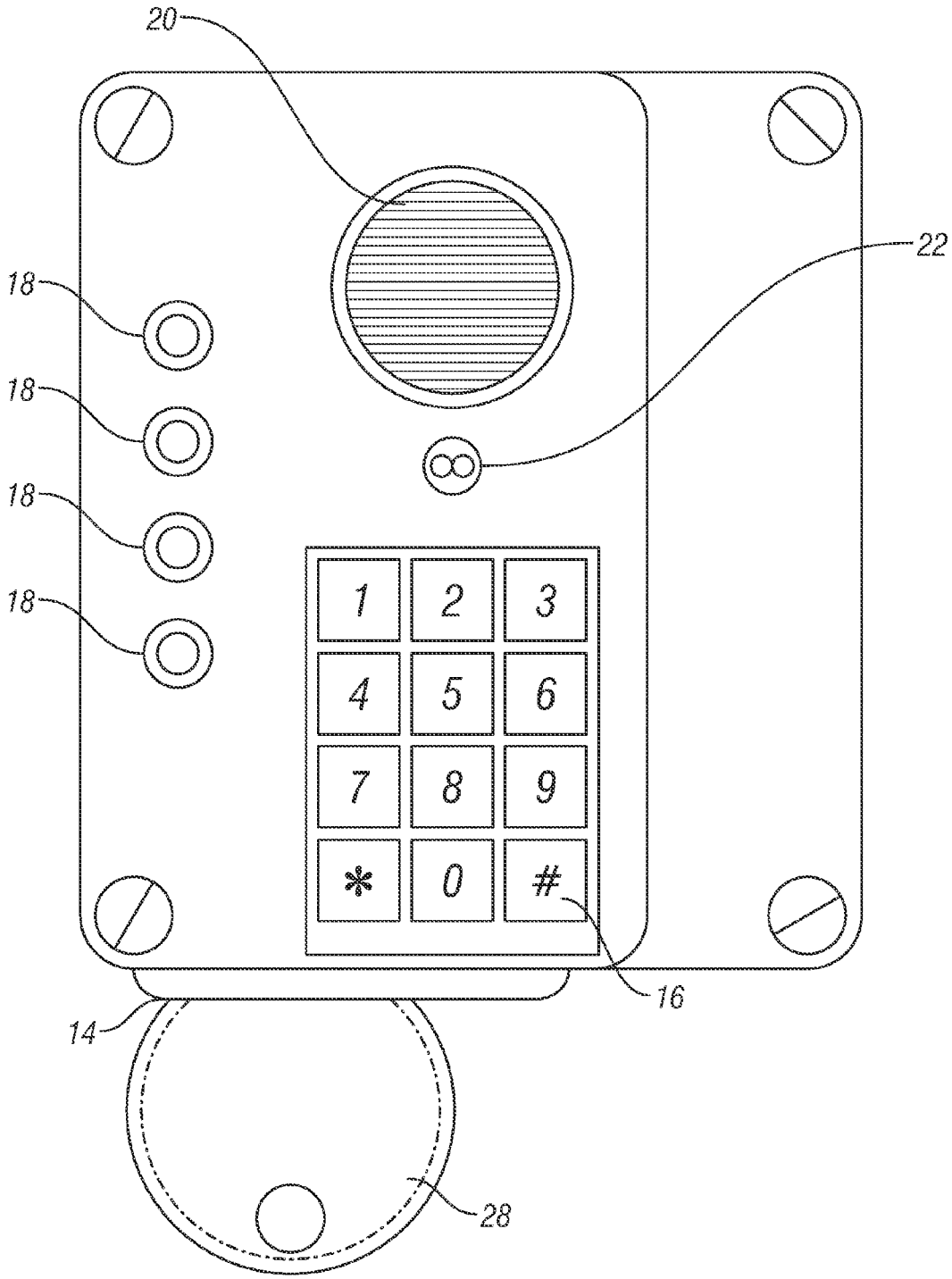
FIG. 2 illustrates a front elevation of an embodiment of security system according to the present invention with a key inserted in a housing of the system.

Referring now to FIG. 2 of the accompanying drawings, there is illustrated an alternative embodiment of security system which is similar to the system of FIG. 1 and like parts are given reference numerals. In this embodiment the key 28 is received directly in the slot 14.

While the preferred embodiments of the invention have been shown and described, it will be understood by those skilled in the art that changes of modifications may be made thereto without departing from the true spirit and scope of the invention.

The invention claimed is:

1. A security system comprising:

a security tag;

at least one fastener releasably attaching the security tag to at least one key; and an electronic security device including a housing which defines an aperture for receiving the security tag, a mechanism for releasably engaging the security tag in the aperture of the housing in a secured configuration while said security device is in a an armed condition, a sensor for monitoring a position of the security tag relative to the aperture of the housing, and a signal generator which actuates a warning signal when said security tag is moved from said secured configuration while said security device is in said armed condition, wherein, when said security tag is in said secured configuration and said security device is in said armed condition, said tag and said at least one key are removable from said housing, said at least one fastener is inaccessible to release said at least one key from said security tag, and at least a portion of said key is visible and disposed external of said housing of said security device.

2. A security system according to claim 1, further comprising:

means for measuring and monitoring an environmental parameter in close proximity to said housing; and a means for actuating an alarm when said environmental parameter falls outside of a predetermined range.

3. A security system according to claim 2, wherein:

said environmental parameter is selected from the group consisting of noise, smoke, heat and carbon-dioxide level.

4. A security system according to claim 1, further comprising:

a vibration detector operable to detect vibration caused by tampering with said security system.

5. A security system according to claim 1, wherein:

said mechanism includes a user operable keypad for inputting a code to lock or disengage said security tag to or from said housing of said electronic security device.

6. A security system according to claim 5, further comprising:

means for illuminating said keypad when said warning signal is actuated by said signal generator.

7. A security system according to claim 5, wherein:

said security device includes an identification means for identifying a particular tag inserted into said aperture of said housing and releasably secured therein, and wherein, a corresponding input code associated with said particular tag may be inputted to said security device to disengage said particular tag from said housing of said security device.

8. A security system according to claim 7, wherein:

said housing defines at least one additional aperture for receiving at least one additional security tag.

9. A security system according to claim 1, further comprising:

at least one light which is operable to illuminate said security device when the warning signal is actuated by said signal generator.

10. A security system according to claim 1, wherein:

said key and said tag are manually removable from said security device when said security tag is disposed in said secured configuration and when said security device is in said armed condition.

11. A security system according to claim 10, wherein:

said key and said tag are manually removable from said security device by pulling on the visible portion of said key.

* * * * *